US007140917B1

(12) United States Patent
O'Halloran et al.

(10) Patent No.: US 7,140,917 B1
(45) Date of Patent: Nov. 28, 2006

(54) SHIELDED ELECTRICAL CONNECTOR HAVING LATCH MEANS, AND METHOD OF FABRICATING SAME

(75) Inventors: Mary O'Halloran, Ennis (IE); Colm Conlon, Ennis (IE); Patrick Tunn, Gatway (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/198,767

(22) Filed: Aug. 5, 2005

(51) Int. Cl.
*H01R 13/648* (2006.01)

(52) U.S. Cl. ..... 439/607; 439/352; 439/931

(58) Field of Classification Search ..... 439/607, 439/352–354, 931
See application file for complete search history.

(56) References Cited

U.S. PATENT DOCUMENTS 5,030,113 A 7/1991 Wilson
5,197,901 A * 3/1993 Hashiguchi ..... 439/352
5,580,268 A 12/1996 Miyazawa
6,102,712 A 8/2000 Nishimura
6,200,146 B1 3/2001 Sarkissian
6,257,914 B1 7/2001 Comerci et al.
6,491,529 B1 12/2002 Gray et al.
6,498,292 B1 12/2002 Holmberg et al.
6,575,769 B1 6/2003 Takeuchi et al.
6,575,772 B1 * 6/2003 Soubh et al. ..... 439/76.1
6,702,602 B1 * 3/2004 Wu ..... 439/352

* cited by examiner

*Primary Examiner*—Truc Nguyen
(74) *Attorney, Agent, or Firm*—Stephen Z. Weiss

(57) ABSTRACT

An electrical connector includes a two-part housing comprising a non-conductive first housing part and a non-conductive second housing part with a conductive layer. A plurality of conductive terminals are mounted on the non-conductive first housing part. The terminals have contact portions for engaging appropriate contacts of a complementary mating connector. A conductive latch member is mounted on the housing in engagement with the conductive layer of the second housing part. The latch member has a latch portion for engaging an appropriate latch of the complementary mating connector.

19 Claims, 4 Drawing Sheets

SHIELDED ELECTRICAL CONNECTOR HAVING LATCH MEANS, AND METHOD OF FABRICATING SAME

FIELD OF THE INVENTION

This invention generally relates to the art of electrical connectors and, particularly, to a shielded electrical connector which has a conductive latch for latching to a complementary mating connector. The invention also generally relates to a method of fabricating the connector.

BACKGROUND OF THE INVENTION

Generally, an electrical connector includes some form of insulative or dielectric housing which mounts one or more conductive terminals. The housing is configured for mating with a complementary mating connector or other connecting device which, itself, has one or more conductive terminals. A connector assembly typically includes a pair of mating connectors, such as plug and receptacle connectors sometimes called male and female connectors. The interengaging terminals of the connectors, themselves, may be male and female terminals.

Some electrical connectors are shielded. In other words, the mating interface of a connector (i.e., where the terminals of the connector mate or engage the terminals of the mating connector) is surrounded by a conductive shield, cover or shroud which typically is fabricated of metal material and provides for EMI and RFI protection. These metal shields typically are separate components which surround at least the mating portions of a dielectric housing of the connector.

Some connectors include latch means for latching a connector to the complementary mating connector. Again, the latch means typically are separate components or exterior cantilevered arms, for instance, on the connector and may be an integral part of the shield. All of these separate components undesirably add to the size of the electrical connector in environments where miniaturization may be necessary or at least desirable. The separate components, particularly the separate shields, add to the manufacturing and assembling costs of the connector and simply complicate the connector's design. The present invention is directed to solving these problems by providing a new and improved shielded electrical connector having a novel and simple latching system, along with a method of fabricating the connector.

SUMMARY OF THE INVENTION

An object, therefore, of the invention is to provide a new and improved electrical connector of the character described, along with a simple and inexpensive method of fabricating the connector.

In the exemplary embodiment of the invention, the connector includes at least a two-part housing having a non-conductive first housing part and a non-conductive second housing part with a conductive layer. A plurality of conductive terminals are mounted on the non-conductive first housing part. The terminals have contact portions for engaging appropriate contacts of a complementary mating connector. A conductive latch member is mounted on the housing in engagement with the conductive layer of the second housing part. The latch member has a latch portion for engaging an appropriate latch of the complementary mating connector.

The invention contemplates that the conductive layer of the second housing part be structured as a shield for covering a substantial termination area of the first housing part and the terminals, particularly the mating interface of the connector. The first housing part includes a mating portion on which the contact portions of the terminals are disposed. The second housing part includes a conductive shroud for substantially covering the mating portion and the contact portions.

As disclosed herein, a pair of the conductive latch members are provided at opposite sides of the connector housing. Preferably, the latch members are fabricated of flexible metal material.

According to one aspect of the invention, the housing includes a latch-receiving passage into which the conductive latch member is inserted. When inserted into the passage, the latch member is in engagement with the conductive layer of the second housing part.

According to another aspect of the invention, the second housing part comprises a non-conductive body covered by a conductive plating at least in an area for engaging the conductive latch member. In the preferred embodiment, the non-conductive body is over molded about portions of the first body part, and the conductive plating is deposited over at least portions of the second body part in engagement with the conductive latch member.

The invention contemplates a method of fabricating the electrical connector and includes the steps of molding first and second juxtaposed housing parts of non-conductive material in mutual adherence to each other. A conductive layer of plating is applied to the exposed surface areas of the second housing part. The conductive latch member is installed in engagement with the conductive layer of plating on the second housing part.

According to the invention, the housing parts may be molded of a liquid crystal polymer in a two-shot molding process, with the second housing part over molded about portions of the first housing part. The second housing part has the polymer mixed with palladium so that metal layers, such as copper and gold, will adhere only to the second housing part. The two-part housing may be etched prior to the plating step to facilitate the adherence of the plating material.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
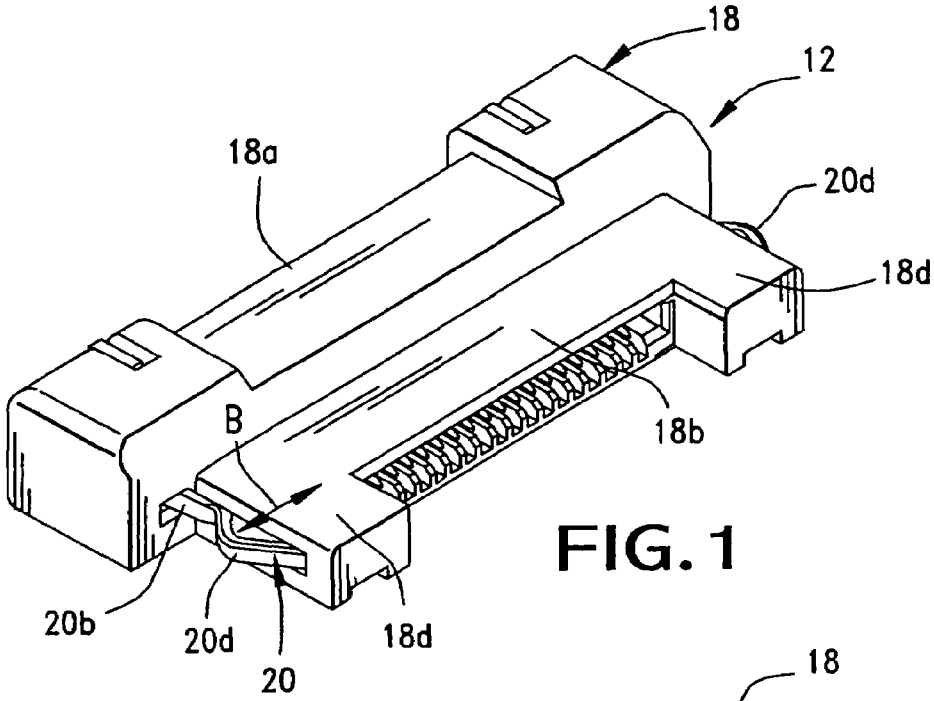
FIG. 1 is a front perspective view of an electrical connector according to the invention.
Figure 2:
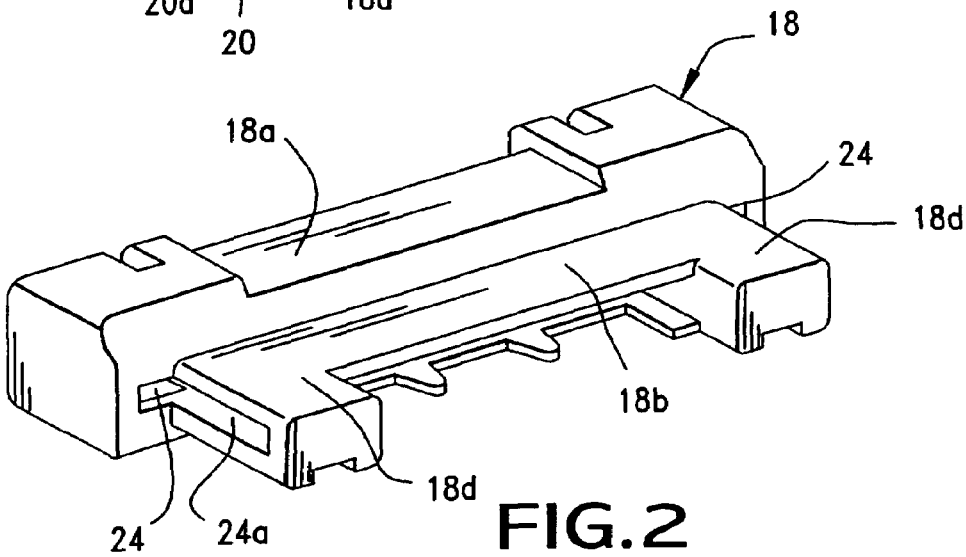
FIG. 2 is a perspective view of the conductive, shielding housing part.
Figure 3:
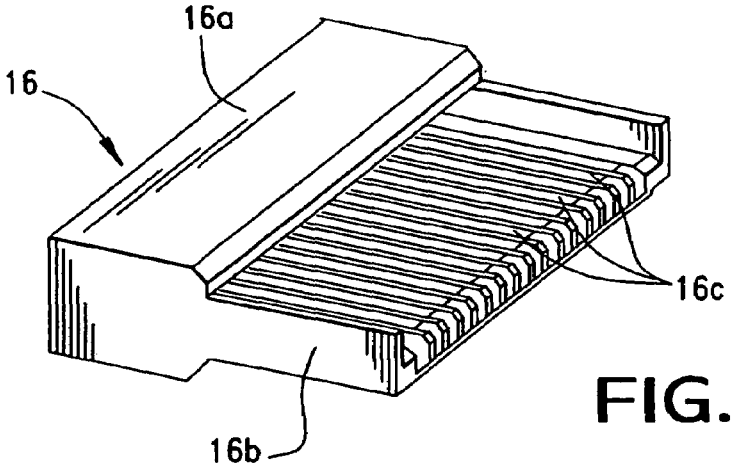
FIG. 3 is a perspective view of the non-conductive housing part.

Referring to the drawings in greater detail, and first to FIGS. 1–3, the invention is embodied in an electrical connector, generally designated 12 (FIG. 1) which includes a two-part housing, generally designated 14. The two-part housing includes a non-conductive first housing part, generally designated 16 (FIG. 3), and a conductive second or shielding housing part, generally designated 18 (FIG. 2). Hereinafter, the non-conductive first housing part 16 will be called the "terminating" housing part, and the conductive second housing part 18 will be called the "shielding" housing part. A pair of latch members, generally designated 20 (FIG. 1) are provided at opposite sides of connector 12 for mating with a complementary mating connector, generally designated 22 in FIG. 8. The latch members will be described in greater detail hereinafter in conjunction with FIG. 4.

Referring to FIG. 3 in conjunction with FIG. 1, terminating housing part 16 is a one-piece structure unitarily molded of dielectric material, such as a liquid crystal polymer. The terminating housing part includes a transverse body portion 16*a* within which a plurality of terminals are mounted as will be seen hereinafter. A mating tongue portion 16*b* projects forwardly from the body portion and includes a plurality of channels 16*c* within which contact portions of the terminals are disposed.

Referring to FIG. 2 in conjunction with FIG. 1, shielding housing part 18 also is a one-piece structure unitarily molded of a liquid crystal polymer about the termination housing part 16. However, the polymer of shielding housing part 18 is mixed with a material, such as palladium, which renders the housing part plateable with a conductive metal plating, as will be described hereinafter while the terminal housing part which renders any exposed portions now non-plateable with a conductive mating plating.

Shielding housing part 18 has a transverse body portion 18*a* which covers the transverse body portion 16*a* (FIG. 3) of the terminating housing part. A shroud portion 18*b* projects forwardly of the body portion over the mating tongue portion 16*b* of the terminating housing part. Therefore, transverse body portion 18*a* and shroud portion 18*b* provide a shield over substantially the entire termination area of the connector. A pair of passages 24 (FIG. 2) are formed at opposite ends of the shielding housing part and within which a pair of the latch members 20 are mounted. The shroud portion 18*b* has a pair of post-like legs 18*d* projecting forwardly from opposite sides or ends thereof. Passages 24 have slot portions 24*a* which extend into legs 18*d* and open outwardly at opposite sides thereof. Flexible latch arms (described hereinafter) of the latch members flex within slot portions 24*a* as can be seen in FIG. 1.

At this point, it should be understood that shielding housing part 18 and terminating housing part 16, in actual practice according to the invention, never appear as stand-alone components as shown in FIGS. 2 and 3. According to the method of the invention (described hereinafter) shielding housing part 18 is over molded about portions of terminating housing part 16 in a two-shot molding process. The shielding housing part has been described above as an isolated component shown in FIG. 2 in order to provide a clear and concise understanding of the configuration of the housing part. Once the shielding housing part 18 is over molded about terminating housing part 16 as shown in FIG. 1, transverse body portion 18*a* and shroud portion 18*b* of the shielding housing part cover transverse body portion 16*a* and mating tongue portion 16*b* of the terminating housing part to shield the mating interface of the connector. Shroud portion 18*b* is spaced above mating tongue portion 16*b* as can be seen in FIG. 1. Appropriately configured core pins of the molding dye extend into and form latch-receiving passages 24 as can be understood from FIGS. 5A and 5B. The result is that inside surfaces of each passage form inside walls of the respective passage of the plateable plastic for engagement by a respective latch member 20, as will be seen below.

Figure 4:
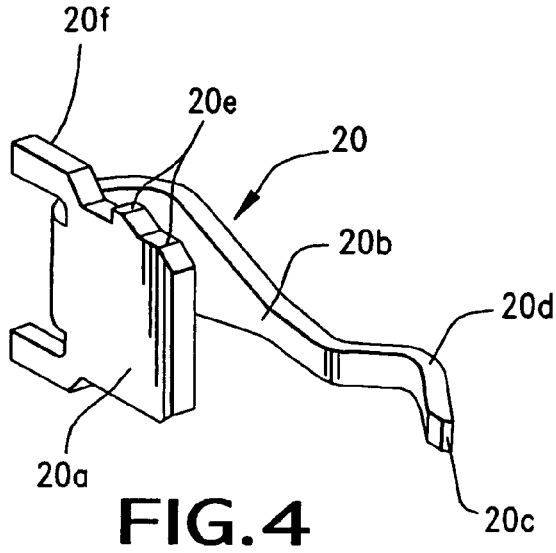
FIG. 4 is a perspective view of one of the latch members.

FIG. 4 shows one of the latch members 20. The latch members are stamped and formed of conductive sheet metal material. Each latch member is generally U-shaped as can be seen in FIG. 4. Each latch member includes a forwardly projecting plate-like fixing portion 20*a* and a forwardly projecting, flexible latch arm 20*b*. The latch arm terminates in a distal end 20*c*, and an outwardly projecting latch hook 20*d* is formed at the distal end of the latch arm. A plurality of teeth 20*e* are stamped at one edge of fixing portion 20*a* for skiving into the walls of a respective passage 24 in conductive housing part 18. Stabilizing fingers 20*f* extend to the rear and to each side of the fixing portion 20*a* to help hold the latch member 20 in the respective passage 24.

Figure 5A:
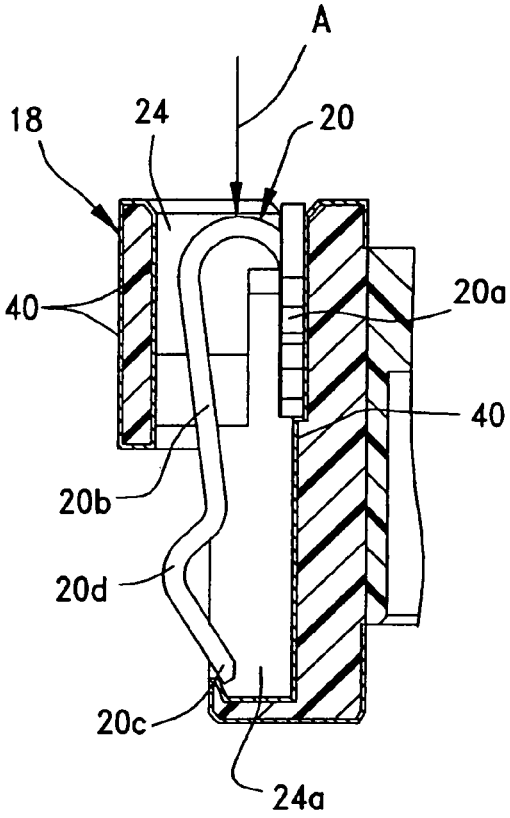
FIG. 5A is an enlarged, fragmented horizontal section through the latch area of the connector, particularly the left-hand side of the connector as viewed in FIG. 1.
Figure 5B:
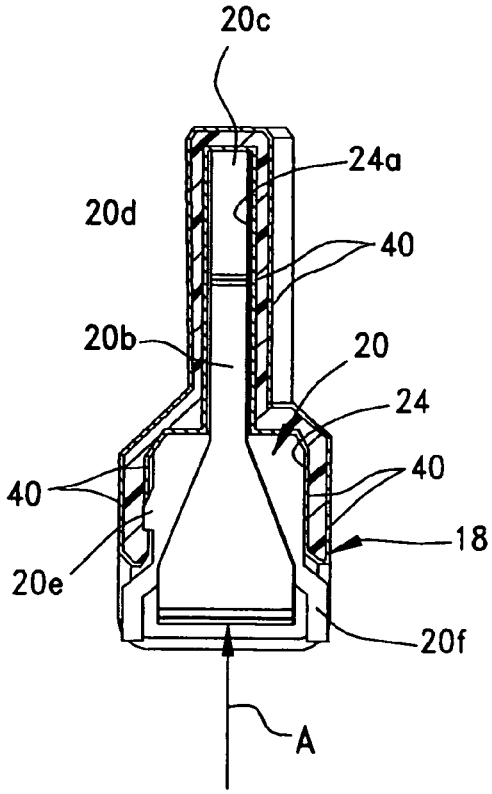
FIG. 5B is an enlarged vertical section through the latch area of the connector.

FIGS. 5A and 5B show one of the latch members 20 inserted in the direction of arrow "A" into one of the latch-receiving passages 24 in shielding housing part 18. When the latch member is fully inserted, fixing portion 20*a* of the latch member, and particularly the top and bottom edges of the fixing portion, establish a press-fit against the top and bottom of the passage to fix the latch member therewithin, particularly as teeth 20*e* of the fixing portion skive into the adjacent wall of the respective passage and as the stabilizing fingers 20*f* engage walls of the latch-receiving passage 24. With the shielding housing part being conductive (as described hereinafter), latch member 20 is electrically commoned to shielding housing part 18. Also, when the latch members 20 are fully inserted or assembled, latch hooks 20*d* are exposed at opposite sides of the shielding housing part as can be seen in FIG. 1. The latch hooks can flex along with latch arms 20*b* in the direction of double-headed arrow "B" (FIG. 1).

Figure 6:
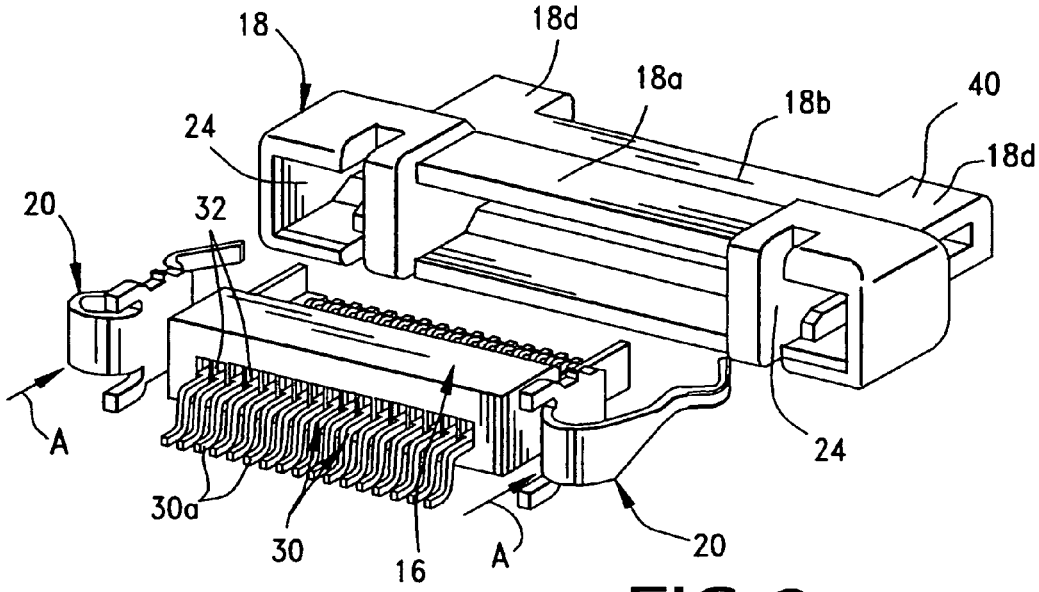
FIG. 6 is an exploded rear perspective view of the connector.
Figure 7:
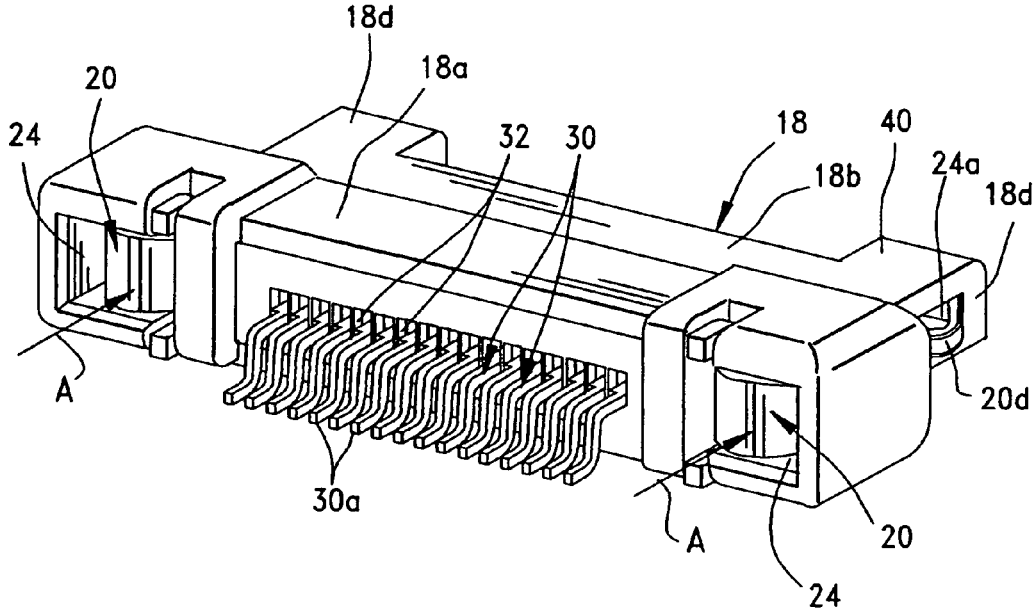
FIG. 7 is a rear perspective view of the connector in assembled condition.

FIGS. 6 and 7 are rear perspective views that show how latch members 20 are inserted into passages 24 in shielding housing part 18 in the direction of arrows "A". FIG. 6 shows terminating housing part 16 separate from the shielding housing part. Again, in actual practice, this separation would never happen, because the shielding housing part is over molded about the terminating housing part in a two-shot molding process described hereinafter. FIG. 7 shows the two latch members 20 fully inserted into their respective latch-receiving passages 24 in the direction of arrows "A". When fully inserted, latch hooks 20*d* of the latch members project outwardly of slot portions 24*a* of the passages.

Before proceeding, FIGS. 6 and 7 show a plurality of conductive terminals, generally designated 30 inserted into a plurality of terminal-receiving passages 32 from the rear of terminating housing part 16. The terminals have contact portions projecting forwardly into channels 16*c* (FIG. 3) in mating tongue portion 16*b* of the terminating housing part. Each terminal 30 includes a tail portion 30*a* for connection to an appropriate circuit trace on a printed circuit board (not shown). When the connector is mated with complementary mating connector 22 (FIGS. 8 and 9), the contact portions of terminals 30 engage appropriate contacts (not shown) of the mating connector.

Figure 8:
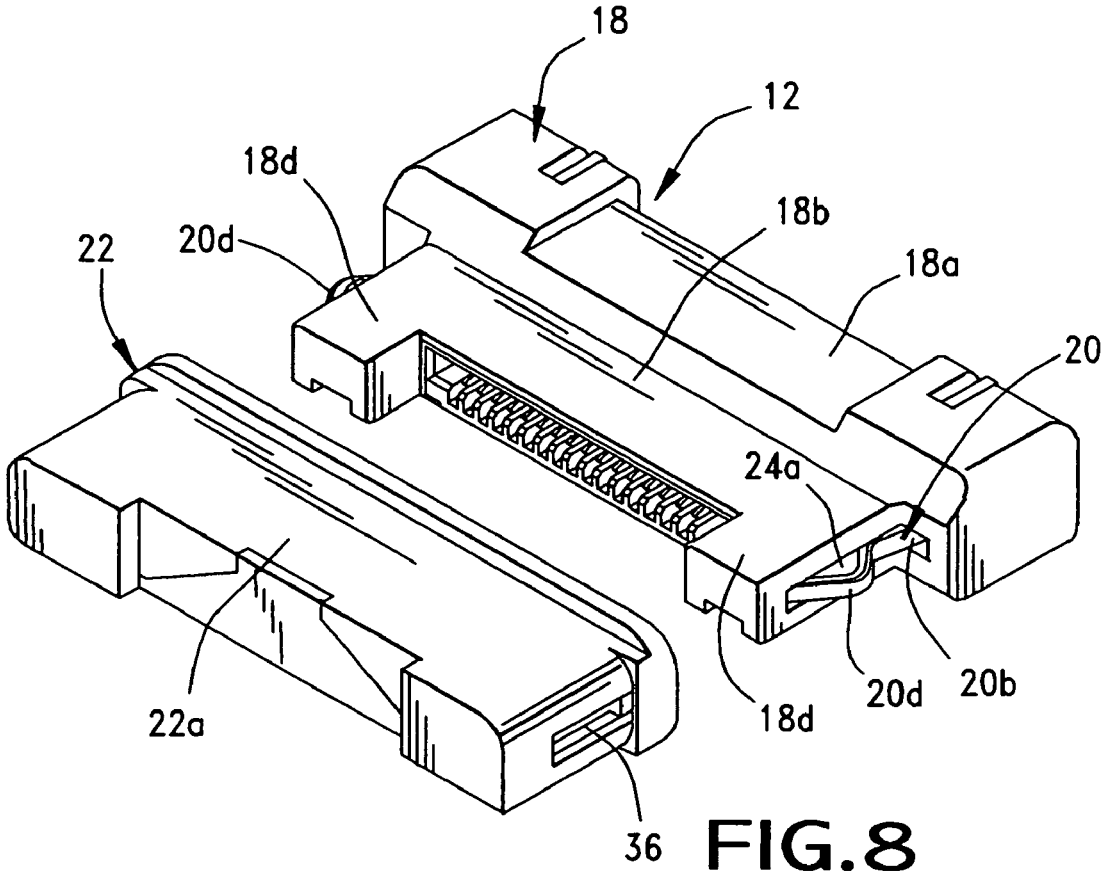
FIG. 8 is a perspective view of the connector about to be mated with a complementary mating connector.
Figure 9:
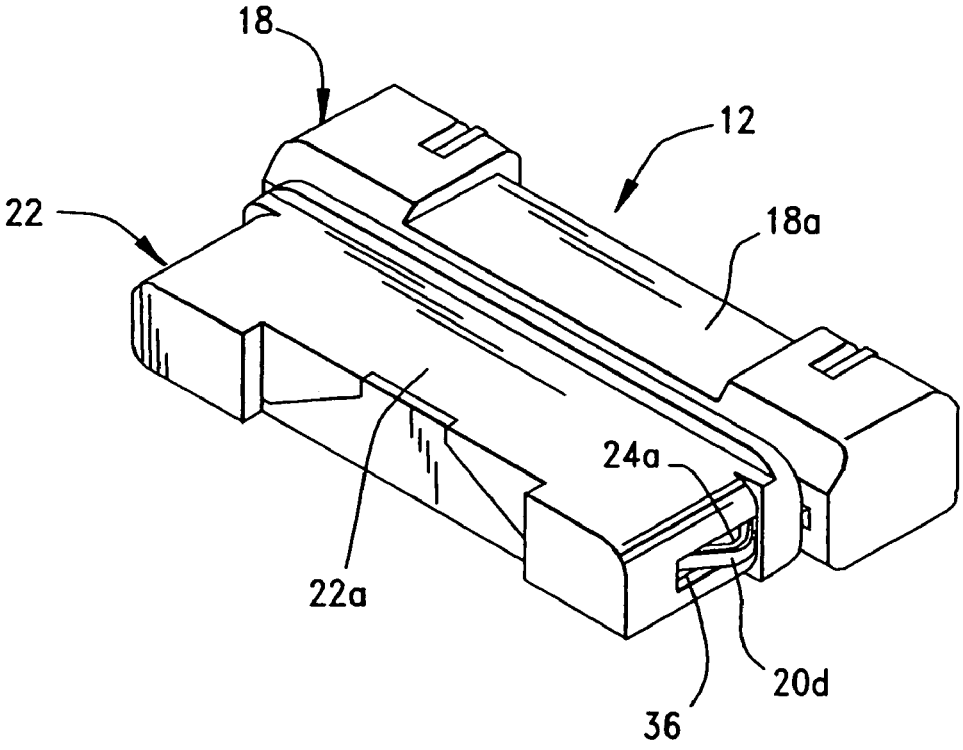
FIG. 9 is a perspective view of the connector mated with the mating connector.

FIGS. 8 and 9 show connector 12 according to the invention mateable with mating connector 22. The mating connector has a shroud portion 22*a* which fits over shroud portion 18*b* and legs 18*d* of shielding housing part 18 when the connectors are mated as seen in FIG. 9. A pair of openings 36 are formed at opposite ends of shroud portion 22*a* of mating connector 22. With latch hooks 20*d* projecting outwardly from slot portions 24*a* as seen in FIG. 8, when the two connectors are mated, the latch hooks will flex inwardly and "snap" back outwardly into openings 36 of the mating connector, due to the flexibility of latch arms 20*b* of latch members 20. Shroud portion 22*a* of the mating connector, preferably, is fabricated of conductive material extending into openings 36 and, therefore, the shroud portion 22*a* is commoned to shielding housing part 18 either by direct contact or by indirect contact between latch hooks 20*d* of conductive latch members and openings 36. The point is that the latch members are conductive and are maintained in contact with the conductive shielding housing part 18 to form conductive extensions thereof.

The method of fabricating the two-part housing 14 (FIG. 1) of connector 12 was generally described above. Specifically, the non-conductive first or terminating housing part 16 is molded in a first "shot" of a two-shot molding process in an appropriately configured molding die. The non-conductive terminating housing part is molded of a high temperature polymer such as syndiotactic polystyrene, liquid crystal polymer or other similar non-conductive materials such as polychromate, ABS or polypropylene. Shielding housing part 18 then is over molded onto the terminating housing part in the molding die in a second shot, as seen in FIG. 1 and described above. The second or shielding housing part is composed of a non-conductive high temperature polymer of the variety similar to the polymer used in the terminating housing part, to which has been added a catalyst which allows the shielding housing part to be plated with a conductive metal material. For instance, the high temperature polymer can be mixed with 100 parts per million of palladium.

The unitarily molded two-part housing then is immersed in a bath of material which will etch all exposed surfaces. The etched two-part housing then is immersed in a bath of electroless copper forming a first plating layer which adheres only to the exposed surfaces of the shielding housing part 18. The housing then is immersed in a bath of electroless nickel phosphorous which adheres only to the copper plating layer. Finally, the housing is immersed into an electroless gold bath to form an outer gold layer over the nickel phosphorous layer, such as on the order of 0.1 micron thickness. Again, all of these metal plating layers are on only the exposed surfaces of shielding housing part 18, that includes the inside surfaces or walls of passages 24 in the shielding housing part, because these inside surfaces are "exposed" within the passages to the plating materials in the baths thereof. With latch members 20 press-fit into passages 24, the conductive latch members are in engagement with the conductive plating on the exposed surfaces of the passages. This plating can be seen clearly in FIGS. 5A and 5B, as at 40, with portions of the latch members in engagement therewith.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

at least a two-part housing including a non-conductive first housing part and a non-conductive second housing part with a conductive layer deposited over at least portions of the non-conductive second housing part;

a plurality of conductive terminals mounted on the non-conductive first housing part and having contact portions for engaging appropriate contacts of a complementary mating connector;

a conductive latch member mounted within a latch receiving passage in the second housing part in engagement with the conductive layer of the second housing part and having a latch portion for engaging an appropriate latch of the complementary mating connector; and the conductive layer of the second housing part being structured as a shield for covering a substantial termination area of the first housing part and the terminals.

2. The electrical connector of claim 1 wherein said first housing part includes a mating portion on which the contact portions of the terminals are disposed, and the conductive layer of the second housing part includes a shroud for substantially covering the mating portion and the contact portions.

3. The electrical connector of claim 1 wherein said conductive latch member is fabricated of flexible metal material.

4. The electrical connector of claim 1, including a pair of said conductive latch members at opposite sides of the housing.

5. The electrical connector of claim 1 wherein said latch receiving passage extends into the housing and includes at least one open side through which the latch member projects.

6. The electrical connector of claim 1 wherein the conductive layer of the second housing part extends into the latch receiving passage for engaging the conductive latch member.

7. The electrical connector of claim 1 wherein said second housing part includes a non-conductive body over molded about portions of the first housing part, and a conductive plating over at least portions of the second housing part in engagement with the conductive latch member.

8. A shielded electrical connector, comprising:

a two-part housing including a non-conductive first housing part having a forwardly projecting mating portion and a second housing part structured as a shield for covering a substantial termination area of the first housing part including a shroud for substantially covering the mating portion of the first housing part;

a plurality of conductive terminals mounted on the non-conductive first housing part and having contact portions on the mating portion for engaging appropriate contacts of a complementary mating connector;

a conductive latch member mounted within a latch receiving passage in the second housing part and having a latch portion for engaging an appropriate latch of the complementary mating connector; and said second housing part including a non-conductive body covered by a conductive plating at least over said shroud and into an area for engaging the conductive latch member.

9. The electrical connector of claim 8 wherein said conductive latch member is fabricated of flexible metal material.

10. The electrical connector of claim 8, including a pair of said conductive latch members at opposite sides of the housing.

11. The electrical connector of claim 8 wherein said latch receiving passage extends into the housing and includes at least one open side through which the latch member projects.

12. The electrical connector of claim 8 wherein said first housing part is molded of dielectric material to which a conductive plating material does not adhere, and the second housing part is molded of a dielectric material to which a plating material adheres.

13. A method of fabricating an electrical connector, comprising:

molding first and second juxtaposed housing parts of non-conductive material in mutual adherence to each other, the first housing part being configured for mounting a plurality of conductive terminals and the second housing part being configured with a passage for receiving a conducive latch member;

applying a conductive eplating to exposed surface areas of the second housing part; and installing a conductive latch member in the latch receiving passage in engagement with the conductive plating on the second housing part, the latch member having a latch portion for engaging an appropriate latch of a complementary mating connector;

wherein the conductive layer of the second housing part being structured as a shield for covering a substantial termination area of the first housing part and the terminals.

14. The method of claim 13 including over molding said second housing part about portions of the first housing part.

15. The method of claim 13 including molding said first housing part of a high temperature polymer.

16. The method of claim 13 including molding said second housing part of a high temperature polymer mixed with palladium.

17. The method of claim 16 including molding said first housing part of a syndiotactic polystyrene.

18. The method of claim 13, including the step of etching the exposed surfaces of the molded housing parts prior to said plating step.

19. The method of claim 13 wherein said plating step comprises plating successive layers of copper and gold.

* * * * *